United States Patent [19]

Schmid

[11] Patent Number: 4,858,338

[45] Date of Patent: Aug. 22, 1989

[54] KINETIC ENERGY RETURNING SHOE

[75] Inventor: Rainer K. Schmid, Eugene, Oreg.

[73] Assignee: Orthopedic Design, Eugene, Oreg.

[21] Appl. No.: 195,699

[22] Filed: May 18, 1988

[51] Int. Cl.[4] ..... A43B 13/18; A43B 13/38

[52] U.S. Cl. ..... 36/44; 36/28; 36/102

[58] Field of Search ..... 36/28, 38, 43, 44, 76 C, 36/102

[56] References Cited

U.S. PATENT DOCUMENTS

| | | | |
|---|---|---|---|
| 3,835,558 | 9/1974 | Revill | 36/44 |
| 4,231,169 | 11/1980 | Toyama et al. | 36/43 |
| 4,360,027 | 11/1982 | Friedlander et al. | 36/44 X |
| 4,597,195 | 7/1986 | Dananberg | 36/28 |
| 4,612,713 | 9/1986 | Brown | 36/44 |
| 4,615,126 | 10/1986 | Mathews | 36/102 |
| 4,628,621 | 12/1986 | Brown | 36/44 |

*Primary Examiner*—Donald Watkins

*Attorney, Agent, or Firm*—Willian Brinks Olds Hofer Gilson & Lione, Ltd.

[57] ABSTRACT

An insert for a shoe sole is provided which includes a strip made of an elastic material disposed between an outer sole portion and an upper sole portion of the sole of a shoe. The strip extends from the outer heel area of the shoe to the border of the large toe area of the shoe. The strip forms a rocker bottom which cradles the first metatarsal head of the foot of the wearer. The roll point of the rocker bottom is disposed in a range of from the toe break of the wearer to approximately 2.5 centimeters behind the toe break of the wearer.

24 Claims, 2 Drawing Sheets

KINETIC ENERGY RETURNING SHOE

BACKGROUND OF THE INVENTION

The present invention relates to an insert for a sole and more particularly to an insert for a sole which absorbs, stores and returns the kinetic energy of a wearer to the wearer's foot.

Recently, considerable efforts have been devoted to develop improved running and other athletic shoes. Currently, there are many different types of running or athletic shoes which purport to provide cushioning from impact and comfort for all phases of activity. Shock absorption has been the primary focus of most of these research efforts. For example, U.S. Pat. No. 4,541,184 (Leighton) discloses an insole which is designed to provide shock absorption in the areas of the foot subject to impact forces from ground contact.

Recent advances in biomechanics however, indicate that cushioned running shoes may decrease the efficiency of the user. Experimenters have found that the arch of the foot acts like a spring, absorbing the energy of impact with the ground and giving it back with surprising efficiency to launch a runner forward again. Cushioned shoes, however, act to absorb the kinetic energy for the athlete. Up to 67% of the kinetic energy of a gait cycle may be absorbed and wasted by conventional athletic shoes.

The problem which must be addressed is not only how to minimize impact and provide comfort for the athlete's foot in running, jumping and other athletic endeavors, but also how to harvest and utilize energy resulting from certain phases of walking or running such as heel strike, midstance and toe off.

Some efforts have been devoted to develop devices which absorb and return a portion of the energy of the impact between a runner's foot and the ground. For example, U.S. Pat. No. 4,628,621 (Brown) discloses a rigid orthotic insert made of a plurality of layers of graphite fibers. The insert includes a mid-arch portion which is slightly raised relative to the rear portion and the forward portion of the insert. The insert however is disposed above the sole on the shoe. As discussed above, up to 67% of the gait cycle may be absorbed by cushioned soles. Therefore, most of the Kinetic energy of the wearer is absorbed before reaching the orthotic insert.

U.S. Pat. No. 4,486,964 (Rudy) discloses a pair of moderators made of spring-type material which absorb and return kinetic energy. A first moderator is disposed in the heel area and absorbs high shock forces at heel strike. This moderator, which is shaped to cup and center the calcaneus at heel strike, elastically deforms and absorbs the energy at heel strike. As the athlete's gait cycle continues and the force on the moderator is reduced it returns the energy to the athlete. The second moderator disclosed by Rudy engages the forefoot of the athlete and has similar properties.

Although the devices of Rudy and Brown return some of the impact energy to the runner, they do not account for the entire gait cycle of an athlete. The gait cycle typically consists of heel strike, midstance, a forward roll of the foot to the ball of the foot (toe break) and toe off. At the start of the gait cycle the initial part of the foot to engage the ground is the outward portion of the heel. This phase of the gait cycle is referred to as heel strike. Next the foot rolls to midstance and then rolls forward to the ball of the foot. In the final phase, referred to here as toe off, the toes propel the foot off the ground. The large toe provides the majority of the propelling thrust during this phase. It may provide up to 70% of the total thrust with the four small toes providing the balance.

Ground reaction forces and the line of progression of ground reaction forces on a runner's foot have been studied by Cavanagh et al., "Ground Reaction Forces in Distance Running", 13 J. Biomechanics, 397 (1980). It would be advantageous to provide a device which utilizes the impact forces developed along the lines of progression of forces along the foot to optimally return the kinetic energy of the wearer's foot back to the wearer throughout the gait cycle.

Shoe mechanics studies also provide other desirable features which advantageously use the mechanics of the gait cycle. For instance Perry et al., "Rocker Shoe as Walking Aid in Multiple Sclerosis", 62 Arch Phys. Med. Rehabil., 59 (1981), demonstrates that clogs with a rocker bottom significantly facilitate ambulation of patients with certain neurologic deficits. The study suggests that a mean savings of 150% of normal energy was gained by multiple sclerosis patients which used a shoe having a rocker bottom sole.

Another factor which must be accounted for is the 25° external torsion of the foot and ankle relative to the knee axis in a gait cycle. That is, at toe off the foot twist outward, at an average angle of 25°, as the knee and hip extend forward.

It would be advantageous to provide a shoe which utilizes the rocker bottom principle along with the biomechanics of the gait cycle to improve the efficiency of an unimpaired athlete. Such a shoe could harvest and utilize the energy resulting from certain phases of walking or running, store up the energy and return the energy to the athlete, thereby improving the efficiency of the athlete.

Therefore it is a primary object of the present invention to provide a shoe sole which will absorb and store the energy of certain phases of running and return the energy to the wearer.

It is a further object of the present invention to provide a shoe sole which achieves improved gait efficiency for an athlete.

It is still a further object of the present invention to provide a shoe sole which advantageously uses the biomechanics of the gait cycle to provide greater efficiency to the user.

SUMMARY OF THE INVENTION

To achieve the foregoing and other objects and in accordance with the purposes of the present invention, the shoe sole insert of the present invention may comprise a strip made of a high tensile material disposed between the outer sole portion and the inner sole portion of a shoe. The strip extends from the outer heel area of the shoe to the large toe area of the shoe. The strip forms a rocker bottom which cradles the first metatarsal head of the wearer's foot. The roll point of the rocker bottom is disposed in a range which extends between the first metatarsal head to approximately 2.5 centimeters behind the toe break of the wearer.

The insert absorbs and stores energy as it is bent at heel strike, midstance and toe off and returns the energy to the wearer during and just following these phases of the gait cycle. The high tensile material actively fights to resume to its pre-existing state, thereby propelling the wearer forward or upward as he desires.

Additional objects, advantages and novel features of the invention will be set forth in part in the description which follows, and in part will become apparent to those skilled in the art upon examination of the following or may be learned by practice of the invention.

DETAILED DESCRIPTION OF THE PRESENTLY PREFERRED EMBODIMENTS

Figure 1:
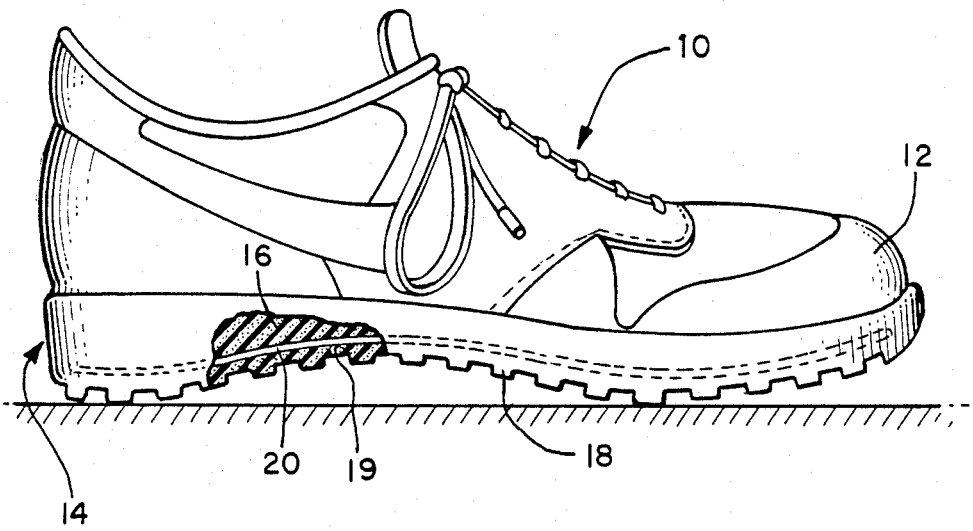
FIG. 1 illustrates a shoe which incorporates a preferred embodiment of the sole insert of the present invention.
Figure 2:
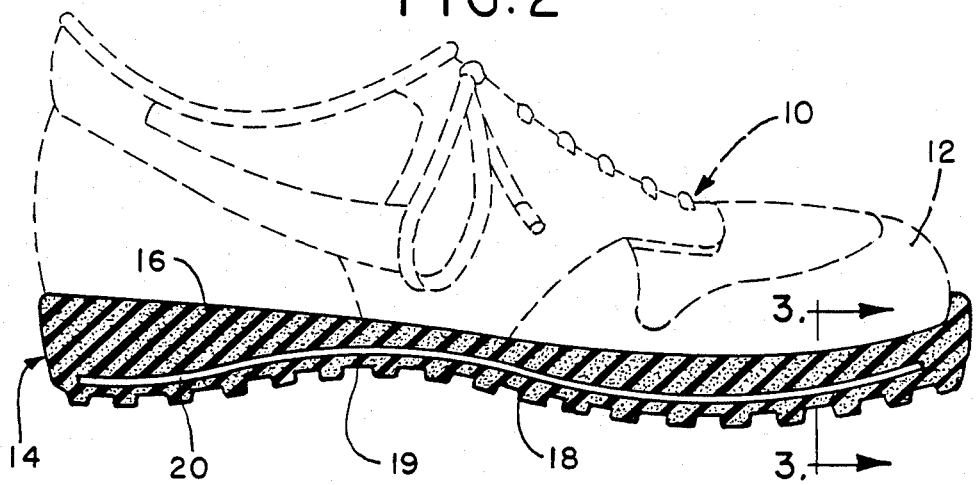
FIG. 2 is a sectional view of the sole of the shoe of FIG. 1 which incorporates a preferred embodiment of the sole insert of the present invention.
Figure 3:
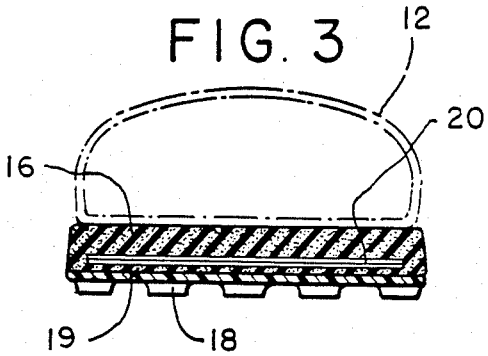
FIG. 3 is a cross-sectional view through lines 3—3 of the sole of FIG. 2.

Referring specifically to FIGS. 1–3 a shoe 10, which is preferably an athletic shoe includes an upper portion 12 and a sole, designated generally by reference numeral 14. The sole 14 includes an upper sole portion 16, an outer sole portion 18 and an insert or inner sole portion 20. The upper sole and outer sole portions may be made of any conventional athletic shoe material such as polyurethane. The insert 20 is disposed between the upper sole portion and the outer sole portion. The sole 14 may include a layer 19 of polyurethane material similar to the material of upper sole portion 16 but preferably is disposed immediately above the outer sole portion 18 as close to the ground as possible. The upper sole portion 16 which is made of conventional shock absorbing material acts to absorb the sock from ground force contact. The outer sole portion 18 which engages the ground is designed with conventional sole threads which provide traction to the wearer.

Figure 7:
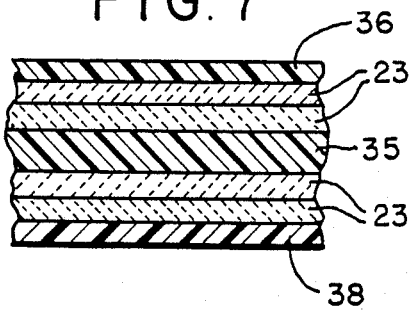
FIG. 7 is a cross-sectional view through lines 7—7 of FIG. 4.
Figure 4:
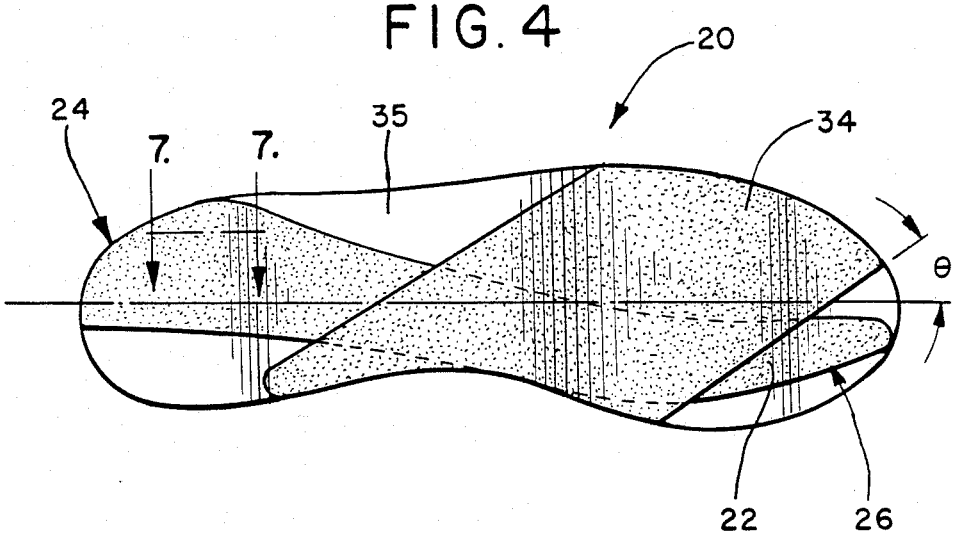
FIG. 4 is a plan view of a preferred embodiment of the sole insert of the present invention.
Figure 5:
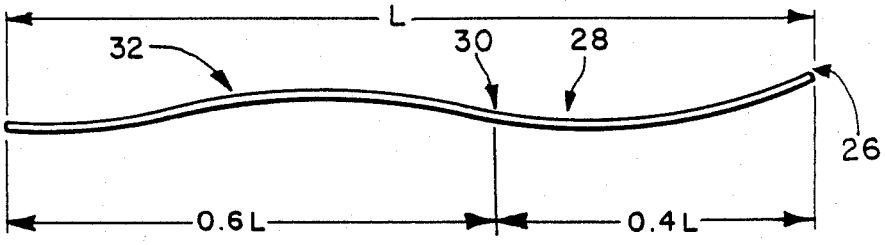
FIG. 5 is a side elevational view of the sole insert of FIG. 4.

Referring now to FIGS. 4, 5 and 7, the inner sole 20 includes a first strip of an elastic material which is defined here as a high tensile strength material which has a modulus of elasticity of at least $32\times10^6$ lb/in$^2$. Preferably, the material will also have a light weight property. A suitable material for the strip 22 is a material made of graphite fibers. Graphite has the advantages that it has high tensile strength, a high modulus of elasticity, is light weight, and as discussed below may be easily processed. The graphite strip 22 may comprise a single layer of graphite fibers but preferably includes a plurality of layers 23. The layers 23 are arranged such that the bottom layer extends from the heel area 24 to the edge of the toe area 26 of the sole 14 and each succeeding layer extends from the heel area 24 and terminates 0.25" proximal to the other, thereby providing a leaf spring arrangement. Preferably the graphite strip 22 extends from the outer lateral border of the heel area 24 and is wider at the heel strike area which gradually tapers to the toe off area.

Referring specifically to FIG. 5, the graphite strip 22 is formed such that a rocker bottom, indicated generally by reference numeral 28 in FIG. 5, cradles the first metatarsal head of the foot of the wearer. The width of the graphite strip 22 is adapted to cover the width of the user's large toe and first metatarsal head. The roll point 30 of the rocker bottom 28 is disposed in a range which extends between the toe break and 2.5 cm. behind the toe break of the wearer. Preferably, the roll point 30 is disposed approximately 60% forward from the posterior margin of the sole 14.

In an exemplary embodiment the insert 20 includes an arch portion, designated generally by reference numeral 32, disposed between the roll point 30 and the posterior margin of the sole 14. The arched portion 32 does not necessarily coincide with the arch of the foot of the wearer but rather forms a mechanical bridge between the lateral edges of the shoe.

A second strip 34 of high strength elastic material extends from the four small toes to approximately the arch area of the foot at the opposite lateral border of the sole 14. The width of the strip 34 is adapted to cover the small four toes and the metatarsal head of the small toes of the wearer. The strip 34 is disposed at an angle $\theta$ which is in a range between 25° and 35° relative to the longitudinal axis of the inner sole 20. The preferred angle is 25° relative to the longitudinal axis of the inner sole 20. In this description the longitudinal axis of the inner sole 20 is defined as a line which extends from the midpoint of the heel to a point between the second and third toe of the wearer. The preferred longitudinal axis extends from the midpoint of the heel to the second toe of the wearer.

The second strip 34 further forms the rocker bottom 28 of the inner sole 20. Preferably, the roll point of the rocker bottom is 60% forward from the posterior margin of the inner sole 20 medially, and tapers obliquely to 57% laterally. The tapering of the roll point in this manner, accommodates for the angle of the metatarsal heads of the foot. The second strip 34 is also arched in section 32 further forming the bridge across the lateral borders of the shoe sole 14.

Referring now specifically to FIG. 7 a layer 35 of a material which absorbs and dampens vibration is disposed between the layers of graphite fibers 23 in strips 22 and 34. The vibrating absorbing material 35 may also be used to generally form the shape of an insole as illustrated in FIG. 4. A suitable vibration absorbing material 35 is an aeromatic polyimide such as a material commercially available as Kevlar from DuPont Corporation.

Preferably the inner sole 20 further includes a first layer of material 36 made of glass fibers disposed on the top and a second layer 38 made of glass fibers disposed on the bottom of the inner sole 20.

In this exemplary embodiment, substantially all of the fibers in graphite strip 22 are aligned along the longitudinal axis of the strip 22. Similarly, substantially all of the graphite fibers in the second strip 34 are aligned along the longitudinal axis of the strip 34. The fibers in the vibration absorbing material, such as Kevlar, have what is known in the art as a crowfoot weaving. The glass fibers have a bidirectional orientation that is, some of the fibers are arranged at a first orientation while the remaining fibers are arranged at an orthagonal angle to the first fibers.

The number of layers of graphite 23 for the first strip 22 depends on the size of the shoe which is to be fitted. Shoes up to a size 10 will preferably include four total layers of graphite 23 in the first strip. While shoes of a size greater than 10 preferably will include five total layers of graphite 23 in the first strip.

Figure 6:
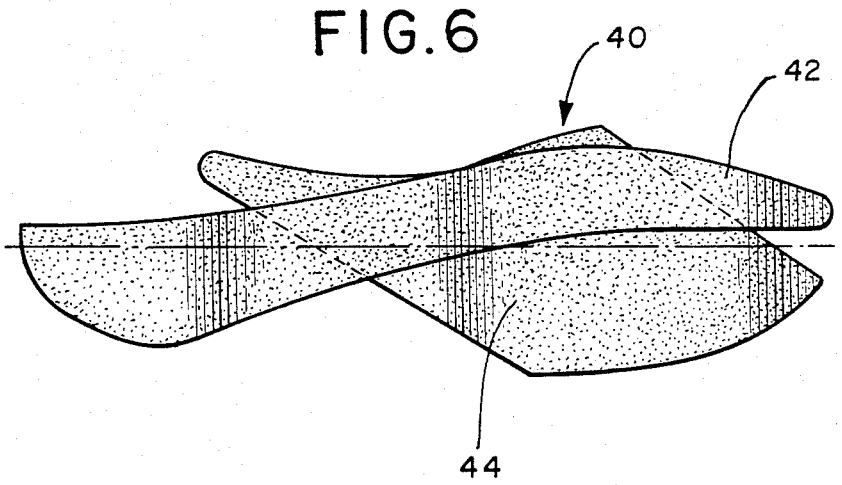
FIG. 6 is a bottom view of an alternative embodiment of the sole insert of the present invention.

FIG. 6 illustrates a bottom view of another preferred embodiment of the insert of the present invention. The insert 40, intended for use in the shoe for a left foot, includes the first strip 42 and a second strip 44 similar to the embodiment of FIGS. 4 and 5. However, the vibration absorbing material and the glass fiber material are incorporated only in the area covered by the two strip 42 and 44, resulting in a generally X-shaped insert. That is, in this embodiment the vibrations absorbing material and the glass fiber material which give the embodiment of FIG. 4 the insole shaped figure are removed or deleted from any area not covered by first strip 42 and second strip 44. This results in the generally X-shaped insert which includes the graphite fibers, vibration absorbing material and the glass fiber material. The embodiment of FIG. 6 provides an insert 40 which is lighter than the embodiment of FIG. 4 and thus may be preferred in sports such as running or jogging in which a lighter shoe is desirable.

The insert or inner sole 20 of the present invention may be made by conventional techniques. For purposes of illustration a preferred method will be described with reference to the embodiment of FIG. 4. A mold which is provided with the rocker bottom shaped in the arch bridge is used to process the insert. A thin strip of glass fiber material 38 is first disposed on the mold. A few layers of graphite 23 are then disposed on the fiberglass layer 38. After two to three layers of graphite 23 have been applied on the mold the layer of vibration absorbing material 34 is disposed on the graphite layers 23. Next two to three additional layers of graphite 23 are disposed on top of the layer of shock absorbing material 34. A final layer of glass fiber material 36 is then disposed on top of the layers of graphite 23. The second strip 34 preferably includes two layers of graphite material which may be disposed above or below the layers in the first strip 22. The mold is then placed in vacuum-tight container. Next the insert 20 is heated to a temperature of approximately 270° F. at a pressure of 60 psi for approximately one hour. The insert 20 is then annealed for one hour to remove the stress from the materials.

The insert of the present invention provides a means for advantageously using the lines of progression of forces from impact on the foot. The first graphite strip is strategically placed along the lines of progression of forces between the ground and the foot. The graphite strips provide a source of rebound energy. The rocker bottom configuration of the insert is utilized to enhance the efficiency of an athlete. Crossed fibers of the straight graphite strip and the angled graphite strip cradle the first metatarsal head of the foot, provide maximum stiffness to resist torsion in both directions and activate the rocker bottom system. The insert of the present invention thus enhances the wearer's efficiency through the entire gait. The embodiment of FIGS. 4 and 5 is used as an example of how the insert functions through a gait cycle.

At heel strike the interior heel portion of the insert 20 is compressed as is the arch portion 32. Just following heel strike and midstance the energy from the insert 20 returning to its original form is returned to the wearer. At toe off the toe portion of the device 20 is bent. Since the graphite fibers provide a fairly elastic structure, the first strip 22 will return stored energy to the user as the insert 20 returns to its original position. In each instance the graphite actively fights to resume its pre-existing state, thereby propelling the athlete forward or upward as he desires.

As discussed above, the majority of the force that is provided by the toes in running is provided by the large toe. The additional thrust provided by the small four toes in toe off. Although not as large as that provided by the large toe, the thrust provided by the four small toes is still a significant factor in the gait cycle. The second strip 34 of the insert 20 accommodates the thrust provided by the small toes. Additionally the second graphite strip 34 accommodates for the average 25° external torsion of the foot and ankle relative to the knee axis during a gait cycle.

The layers of glass fiber material 36 and 38 of the insert 20 add resiliency to the insert 20 thereby preventing twisting and torquing of the insert 20. The layer of vibrating absorbing material 35 dampens impact associated with all phases of activity, thus enhancing the comfort of the user.

Since the device of the present invention permits but dampens distortion and actively pursues return to the resting state, injuries such as ankle sprain, shin splints or other nagging problems may be minimized. The insert of the present invention not only accommodates but innovatively enhances the performance of athletes who use athletic shoes as an important feature of their sporting endeavor.

Therefore the insert of the present invention when incorporated in a sole provides a shoe which may be particularly useful in athletic shoes. The insert may be useful in activities such as walking jogging, sprinting, aerobics, distance running, high jumping, poll volting, bicycling, and tennis. The number of graphite layers employed is selected to accommodate the weight and size of different users. Thus the insert may be used by persons of virtually all ages and body types.

The foregoing description of the preferred embodiments of the present invention has been presented for purposes of illustration and description. It is neither intended to be exhaustive or to limit the invention to the precise forms disclosed. Obviously many modifications and variations are possible in light of the above-teachings. It is therefore intended that the scope of the invention be defined by the following claims, including all equivalents.

I claim:

1. A sole for a shoe used by a wearer comprising:
an upper sole portion;
an outer sole portion; and
an inner sole disposed between said upper sole portion in said outer sole portion, said inner sole portion including a first strip of an elastic material extending from the outer heel portion to the large toe area of said outer sole portion, said first strip forming a rocker bottom adapted to cradle the first metatarsal head of the foot of said wearer, the roll point of said rocker bottom being disposed in a range of from the toe break of said wearer to approximately 2.5 cm. behind the toe break of said wearer.

2. The sole of claim 1 wherein said inner sole further comprises a second strip of an elastic material, said second strip adapted to receive the four small toes of said wearer and extending from the four small toe area to the opposite lateral border of said outer sole portion, said second strip having an orientation in a range of from 25° to 35° with respect to the longitudinal axis of the sole, said second strip further forming said rocker bottom and adapted to cradle the metatarsal heads of said four small toes of said wearer.

3. The sole of claim 2 wherein said elastic material comprises at least one layer of a graphite material.

4. The sole of claim 2 wherein said roll point of said rocker bottom is disposed 60% forward from the posterior margin of said outer sole portion medially and tapers obliquely to 57% laterally.

5. The sole of claim 4 wherein said first and said second strips form an arch extending laterally across said sole, said arch being disposed between said roll point and the posterior edge of said sole.

6. The sole of claim 3 wherein said first strip comprises a plurality of graphite layers.

7. The sole of claim 6 wherein the bottom layer of said graphite layers of said first graphite strip extends to the border of said big toe area of said outer sole and wherein each succeeding layer terminates proximal to the previous layer.

8. The sole of claim 7 wherein said second strip comprises a plurality of graphite layers.

9. The sole of claim 8 further comprising a layer of vibration absorbing material disposed between two of said layers of graphite in said first and second strips.

10. The sole of claim 9 further comprising a layer of glass fiber material disposed on each side of said graphite strips.

11. The sole of claim 1 wherein said elastic material comprises at least one layer of graphite fibers and wherein substantially all of said graphite fibers are aligned along the longitudinal axis of said first strip.

12. The sole of claim 2 wherein said elastic material in said first and second strips comprises at least one layer of graphite fibers and wherein substantially all of the graphite fibers in said first strip are aligned along the longitudinal axis of said first strip and substantial all of the graphite fibers of said second strip are aligned along the longitudinal axis of said second strip.

13. A sole insert for use in a shoe including a sole and used by a wearer said insert comprising a first strip of an elastic material extending from the outer heel portion to the large toe area of said shoe, said first strip forming a rocker bottom adapted to cradle the first metatarsal head of the foot of said wearer, the roll point of said rocker bottom being disposed in a range of from the toe break of said wearer to approximately 2.5 cm. behind the toe break of said wearer.

14. The insert of claim 13 further comprising a second strip of an elastic material, said second strip adapted to receive the four small toes of said wearer and extending from the four small toe area to the opposite lateral border of said shoe, said second strip having an orientation in a range of from 25° to 35° with respect to the longitudinal axis of said sole of said shoe, said second strip further forming said rocker bottom and adapted to cradle the metatarsal heads of said four small toes of said wearer.

15. The insert of claim 14 wherein said elastic material comprises at least one layer of a graphite material.

16. The insert of claim 15 wherein said roll point of said rocker bottom is disposed 60% forward from the posterior margin of said sole of said shoe medially and tapers obliquely to 57% laterally.

17. The insert of claim 16 wherein said first and said second strips form an arch extending laterally across said sole, said arch being disposed between said roll point and the posterior edge of said sole.

18. The insert of claim 17 wherein said first strip comprises a plurality of graphite layers.

19. The insert of claim 17 wherein the bottom layer of said graphite layers of said first graphite strip extends to the lateral border of said big toe area of said sole and each succeeding layer terminates proximal to the previous layer.

20. The insert of claim 19 wherein said second strip comprises a plurality of graphite layers.

21. The insert of claim 20 further comprising a layer of vibration absorbing material disposed between two of said layers of graphite in said first and second strips.

22. The insert of claim 21 further comprising a layer of glass fiber material disposed on each side of said graphite strips.

23. The insert of claim 13 wherein said elastic material comprises at least one layer of graphite fibers and wherein substantially all of said graphite fibers are aligned along the longitudinal axis of said first strip.

24. The insert of claim 14 wherein said elastic material in said first and second strips comprises at least one layer of graphite fibers and wherein substantially all of the graphite fibers in said first strip are aligned along the longitudinal axis of said first strip and substantially all of the graphite fibers of said second strip are aligned along the longitudinal axis of said second strip.

* * * * *